US009683572B2

(12) United States Patent
Liang et al.

(10) Patent No.: US 9,683,572 B2
(45) Date of Patent: Jun. 20, 2017

(54) DRAINAGE PUMP DEVICE FOR WASHING MACHINE AND WASHING MACHINE THEREWITH

(75) Inventors: Haishan Liang, Qingdao (CN); Peishi Lv, Qingdao (CN); Sheng Xu, Qingdao (CN); Haitao Li, Qingdao (CN)

(73) Assignees: HAIER GROUP CORPORATION, Qingdao, Shandong (CN); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 530 days.

(21) Appl. No.: 14/355,294

(22) PCT Filed: Dec. 28, 2011

(86) PCT No.: PCT/CN2011/084821

§ 371 (c)(1),
(2), (4) Date: Apr. 30, 2014

(87) PCT Pub. No.: WO2013/067739

PCT Pub. Date: May 16, 2013

(65) Prior Publication Data

US 2014/0255155 A1 Sep. 11, 2014

(30) Foreign Application Priority Data

Nov. 8, 2011 (CN) ..... 2011 1 0349833

(51) Int. Cl.
*F04D 19/02* (2006.01)
*D06F 39/08* (2006.01)

(52) U.S. Cl.
CPC ..... *F04D 19/02* (2013.01); *D06F 39/085* (2013.01)

(58) Field of Classification Search
CPC ..... D06F 39/085; D06F 39/083; D04D 19/02
(Continued)

(56) References Cited

U.S. PATENT DOCUMENTS 5,868,011 A * 2/1999 Hawkins ..... D06F 39/083 137/247.41
6,402,962 B1 * 6/2002 Bruntz ..... B01D 29/66 210/108

(Continued)

FOREIGN PATENT DOCUMENTS

CN 201507484 U 6/2010
CN 201802640 U 4/2011

(Continued)

OTHER PUBLICATIONS

International Search Report (PCT/ISA/210) mailed on Apr. 5, 2012, by the Chinese Patent Office as the International Searching Authority for International Application No. PCT/CN2011/084821.

*Primary Examiner* — Phutthiwat Wongwian
*Assistant Examiner* — Jason T Newton
(74) *Attorney, Agent, or Firm* — Buchanan Ingersoll & Rooney PC

(57) ABSTRACT

A draining pump for a washing machine and the washing machine thereof are disclosed. The washing machine includes an inlet system, and a draining system containing the draining pump device. The draining pump has a draining motor, a pump shell, a spinning blade and a filter, wherein, an inlet nozzle and an outlet nozzle are also arranged on the pump shell, and the pump shell is internally arranged with a front pump chamber and a rear pump chamber which are communicated according to the water draining sequence; the spinning blade is arranged in the rear pump chamber and installed coaxially with a revolving shaft of the drain motor, the filter is arranged in the front pump chamber, and a pressure relief plate with pressure relief holes is arranged at one side of the outlet of the filter corresponding to the water spinning blade.

15 Claims, 3 Drawing Sheets

(58) Field of Classification Search
USPC ..... 68/12.19; 415/121.2
See application file for complete search history.

(56) References Cited

U.S. PATENT DOCUMENTS

| | | | | |
|---|---|---|---|---|
| 7,243,512 | B2 | 7/2007 | Kim et al. | |
| 2005/0246843 | A1* | 11/2005 | Song | D06F 39/10 8/158 |
| 2006/0042656 | A1 | 3/2006 | Welch | |
| 2007/0240457 | A1* | 10/2007 | Jang | D06F 39/083 68/18 F |
| 2007/0256458 | A1* | 11/2007 | Jang | D06F 39/083 68/23.1 |
| 2008/0276657 | A1* | 11/2008 | Kim | A47L 15/4206 68/12.13 |
| 2011/0214456 | A1* | 9/2011 | Jang | D06F 39/083 68/12.19 |

FOREIGN PATENT DOCUMENTS

| | | | | |
|---|---|---|---|---|
| CN | 102191669 | A | 9/2011 | |
| DE | 102008054998 | B3 * | 6/2010 | D06F 39/08 |
| FR | 2094401 | A5 | 2/1972 | |
| GB | 1358531 | A | 7/1974 | |
| JP | 2005-319282 | A | 11/2005 | |
| KR | 20-2009-0000761 | U | 1/2009 | |
| WO | 00/46440 | A1 | 8/2000 | |
| WO | 2007/057833 | A1 | 5/2007 | |

* cited by examiner

DRAINAGE PUMP DEVICE FOR WASHING MACHINE AND WASHING MACHINE THEREWITH

FIELD OF THE INVENTION

The invention relates to a washing machine, in particular to a washing machine with a draining pump device and a low-noise draining pump thereof.

BACKGROUND OF THE INVENTION

Household electric washing machine is divided into impeller type washing machine, roller washing machine and agitator washing machine, wherein, roller washing machine was first applied in Europe. With the changes of people's consumption level and concept, roller washing machine has been more and more widely accepted by Asian people. In the meantime, with the continuous improvement of social living environment and family life quality of washing machine users, quiet living environment has attracted more and more public attention. Furthermore, household appliance noise has also become one of the important issues to be solved by each manufacturer, in which, silent index of washing machine has been raised increasingly.

Roller washing machine adopts upper-drainage method, and the water in the tub is discharged to the outside via draining pump and draining pipe. During draining, the buzz noise generated from the water flow impact inside the water pipe on draining pump can't be settled thoroughly. After the water in the roller washing machine is drained, due to a 1.2 m lift in the drain pump, the water stored in this section of water pipe can't be discharged, instead, it impacts the impeller of draining pump under the gravity. Then the water stored in this section of water pipe is tossed out by the impeller, thereby causing the buzz noise. The existing low-end washing machine is adopted with a water level sensor, and the draining pump device runs only during the whole spinning process. Even the high-end washing machine is adopted with a water level sensor, though it can judge the lowest water level at low water level and stop the operating of the draining pump, the signal of the sensor may drift under disturbance. Thus causes misjudgment easily. As a result, there still exists noise or incomplete drainage, which cannot meet the low-noise requirement of users.

The Chinese Patent Application No. CN200920230820.4 discloses a low-noise pump shell of the draining pump for washing machine, which mainly comprises an anti-explosion hole on end face of the inner wall of the pump between the pump chamber near to the water outlet on the pump shell and filter chamber. But this anti-explosion hole is lower than the water outlet, i.e. air-water mixture forms in the pump chamber. It is unable to solve that the noise is generated in the backflow impact of the water inside the drain pipe on the impeller.

In view of that, the invention is provided.

SUMMARY OF THE INVENTION

The invention overcome the deficiency of the prior art, and provides a draining pump for washing machine, which can reduce noise.

Another object of the invention is to provide a washing machine with the draining pump.

To solve the aforesaid technical problems, the main technical scheme in the invention is: a draining pump device for washing machine, comprising a draining motor, a pump shell, a spinning blade, a filter, wherein, an inlet nozzle and an outlet nozzle are arranged on the pump shell, and a front pump chamber and a rear pump chamber are arranged in the pump shell in sequence according to water flow and communicates each other, the spinning blade is arranged in the rear pump chamber and is coaxial with a revolving shaft of the draining motor, the filter is arranged in the front pump chamber, and a pressure relief plate with pressure relief holes is arranged at one side of the filter outlet of the filter next to the spinning blade.

The outlet nozzle is radially arranged on the pump shell of the rear pump chamber along the spinning blade, and the inlet nozzle is arranged on the pump shell of the front pump chamber in such a way that it is perpendicular to the axial direction of the front pump chamber.

One end of the front pump chamber is communicated with the rear pump chamber, and the other end is an opening which is closed through a mounting end cover, and the filter is arranged in the front pump chamber through the opening.

The mounting end cover and the filter are an integral structure and are relatively rotatable, and the mounting end cover is connected with the front pump chamber through threads in a sealing way.

The filter is a cylindrical frame structure, one end of which is a supporting plate, and the other end is the filter outlet, wherein, the supporting plate is connected with the filter outlet via supporting sheets; the filter outlet is of a hollow cylindrical structure, and a pressure relief plate is coaxially arranged on one end of the hollow cylindrical structure near to the spinning blade.

The pressure relief plate is of a circular ring structure, wherein the inner diameter of the circular ring is identical with that of the filter outlet and less than the outer diameter of the spinning blade, and the circular ring is evenly provided with pressure relief holes.

The outer diameter of the filter outlet is less than the diameter of the supporting plate, the supporting sheet is of a L-shaped structure, and the length of the hollow cylindrical structure is less than the distance between the supporting plate and the pressure relief plate. Preferably, the length of the hollow cylinder does not completely block the inlet path of the inlet nozzle.

A positioning bump is arranged on one side of the supporting plate facing to the inner wall of the front pump chamber, and the inner wall of the front pump chamber is axially provided with a positioning slot matched with the positioning bump along the front pump chamber from the opening, and the positioning slot is not the same axial line with the inlet nozzle.

2-4 sets of the supporting sheets are provided, wherein, 2 sets are the preferred.

A circular rib for supporting the pressure relief plate is arranged between the front and rear pump chambers, the maximum diameter of the pressure relief plate is more than the inner diameter of the circular rib, and the outer diameter of the spinning blade is matched with the inner diameter of the circular rib.

The pressure relief holes are one or more shapes selected from round, oval, square or strip through-holes, and the total area of the pressure relief holes is 0.2-1 times of the section area of the outlet nozzle.

The washing machine in the invention, comprises an inlet system, a draining system containing a draining pump, wherein the draining pump device comprises a draining motor, a pump shell, a spinning blade, a filter, wherein, an inlet nozzle and an outlet nozzle are arranged on the pump shell, and a front pump chamber and a rear pump chamber are arranged in the pump shell in sequence according to water flow and communicates each other, the spinning blade is arranged in the rear pump chamber and is coaxial with a revolving shaft of the draining motor, the filter is arranged in the front pump chamber, and a pressure relief plate with pressure relief holes is arranged at one side of the filter outlet of the filter next to the spinning blade.

Compared with the prior arts, the invention achieve the following beneficial effects by utilizing the aforesaid technical scheme:

In the draining pump disclosed in the invention, the pump shell is internally arranged with a front pump chamber and a rear pump chamber which are communicated according to the water draining sequence, and a pressure relief plate with pressure relief holes is arranged at one side of the outlet of the filter corresponding to the water spinning blade. According to the aforesaid improvements described in the present invention, during draining, after the water is drained by the drain pump, due to that in the dewater procedure, the water in the clothes will be shaken off continually, the drain pump will not stop working; at this moment, under gravity, the backwater in the drain pipe may have a large impact on the air in the pump chamber, and the air in the pump chamber can be released via the pressure relief holes, thereby avoiding the buzz noise generating during the spin drying of the washing machine. The improved structure of the present invention is simple and reliable, which can achieve the noise reduction effect at a low cost with low failure rate, and let the consumers get rid of the noise in laundry process with more humanized design.

Combining with the drawings below, further elaborate the specific embodiments.

The labels as shown in the figure are: 1. a pump shell, 2. an inlet nozzle, 3. a pressure relief plate, 4. a spinning blade, 5. a draining motor, 6. an outlet nozzle, 7. a positioning bump, 8. a filter, 81. supporting sheets, 82. a filter outlet, 83. a mounting end cover, 84. a supporting plate, 9. an opening, 91. a rear pump chamber, 92. a front pump chamber, 93. a circular rib.

EMBODIMENTS

Figure 1:
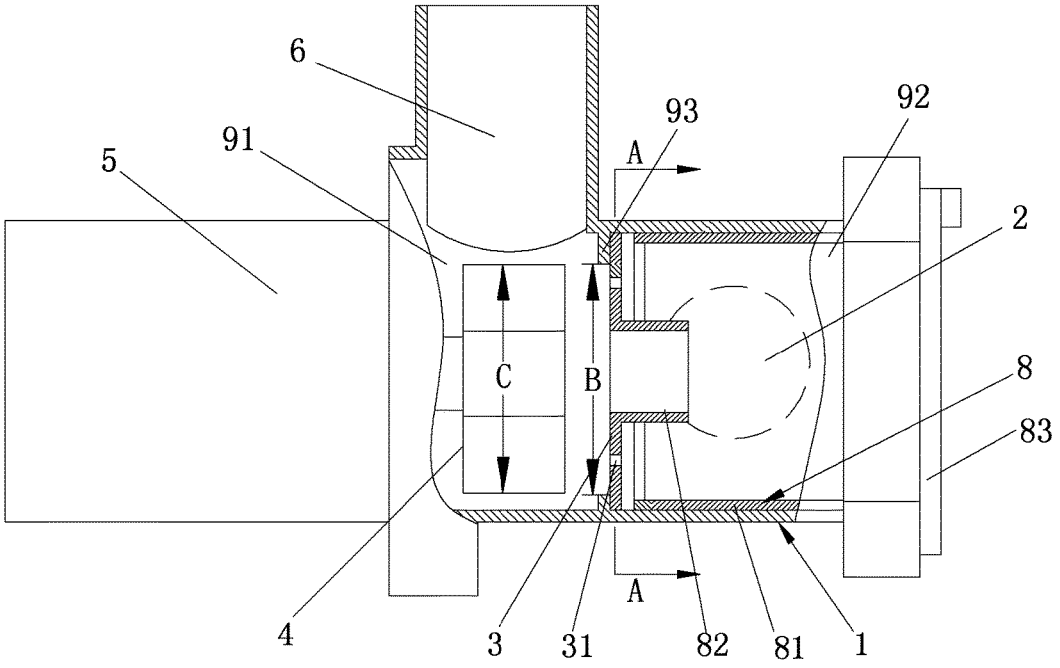
FIG. 1 is a schematic drawing of the draining device of the embodiment of the invention.

The washing machine in the invention comprises an inlet system, a draining system containing a draining pump. As shown in FIG. 1, the draining pump for washing machine comprises a pump shell 1, and a front pump chamber 92 and a rear pump chamber 91 being arranged in the pump shell 1 in sequence according to water flow and communicating each other, i.e. the right pump chamber and left pump chamber as shown in the Figure. And a circular rib 93 is arranged between the front pump chamber 92 and the rear pump chamber 91.

A spinning blade 4 is arranged in the rear pump chamber 91 and installed coaxially with a revolving shaft of a drain motor 5. A filter 8 is arranged in the front pump chamber 92. An outlet nozzle 6 is radially arranged on the pump shell of the rear pump chamber 91 along the water spinning blade 4, and an inlet nozzle 2 is arranged on the pump shell of the front pump chamber 92 perpendicular to the axial direction of the front pump chamber. One end of the front pump chamber 92 communicates with the rear pump chamber 91, and the other end is an opening 9, through which the filter 8 is installed in the front pump chamber 92, The opening 9 is sealed via a mounting end cover 83.

The mounting end cover 83 is an independent and detachable integral mechanism installed on the opening 9, or the mounting end cover 83 is connected with the filter 8 as an integrated structure. The mounting end cover 83 and the filter 8 are relatively rotatable. The mounting end cover 83 is connected with the opening 9 of the front pump chamber 92 through threads in a sealing way, or bolt and other detachable connection way.

The filter 8 is a cylindrical frame structure, one end of which is a supporting plate 84, and the other end is a filter outlet 82. The supporting plate 84 is connected with the filter outlet 82 via a supporting sheet 81. The filter outlet 82 is of a hollow cylindrical structure, and a pressure relief plate 3 is coaxially arranged on one end of the hollow cylindrical structure near to the spinning blade 4. If the mounting end cover 83 is connected with the filter outlet 8, the mounting end cover 83 is connected with the supporting plate 84 relatively rotatablely.

The pressure relief plate 3 is of a circular ring structure. The inner diameter of the circular ring is identical with that of the filter outlet 82, and less than the outer diameter of the spinning blade 4. The circular ring is evenly provided with pressure relief holes 31 with one or more shapes selected from round, oval, square or strip through-holes. The total area of the pressure relief holes 31 is 0.2-1 times of the section area of the outlet nozzle 6.

Preferably, the outer diameter of the filter outlet 82 is less than the diameter of the supporting plate 84. The supporting sheets 81 are L-shaped structure. The length of the hollow cylinder (the filter outlet 82) is less than the distance between the supporting plate 81 and the pressure relief plate 3. Preferably, the length of the filter outlet 82 does not completely block the inlet path of the inlet nozzle 2.

In the invention, to prevent the rotating the filter 8 in the front pump chamber 92 from influencing drainage efficiency, a positioning bump 7 is arranged on one side of the supporting sheets 81 facing to the inner wall of the front pump chamber 92. The inner wall of the front pump chamber 92 is axially provided with a positioning slot (not shown in the figures) matching the positioning bump 7 along the front pump chamber 92 from the opening 9. To avoid the supporting sheets 81 blocking the inlet path of the inlet nozzle 2, the positioning slot is not on the same axial line with the inlet nozzle. 2-4 sets of the supporting sheets are provided, wherein, 2 sets are the preferred.

During the draining of the washing machine, the water in the washing tub of the washing machine flows in the front pump chamber 92 and the rear pump chamber 91 from the inlet nozzle 2 until full. Then under the action of the spinning blade 4, the water is discharged from the outlet nozzle 6 to the outside of the washing machine through the draining pipe. When the water flows from the front pump chamber 92 to the rear pump chamber 91, coins or sundries are blocked in the front pump chamber 92 of the exterior of the filter outlet through the filter outlet 82. It is avoided that coins or sundries go in the rear pump chamber 91 and damage on the spinning blade 4. When the water in the washing tub is almost drained, few water flows into the front pump chamber 92 through the inlet nozzle 2. At this moment, the water in the outlet nozzle 6 and the draining pipe (not shown in the figures) of washing machine refluxes under gravity, and impacts the rear pump chamber 91 at a high speed. Then, the air in the rear pump chamber 91 possesses certain pressure under the centrifugal force during the rotation of the spinning blade, and the pressure in the rear pump chamber 91 may flow into the front pump chamber 92 via the pressure relief holes 31 on the pressure relief plate 3 within a short period. Since the front pump chamber 92 and the inlet nozzle 2 are communicated with the washing tub, the air in the rear pump chamber can flow in the front pump chamber and the communicated tub via the pressure relief holes 31, thereby reducing the buzz noise.

Figure 2:
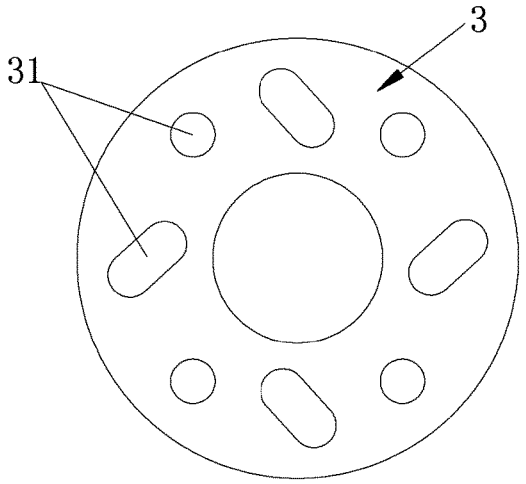
FIG. 2 is an A-A auxiliary view of the pressure relief plate in FIG. 1.
Figure 3:
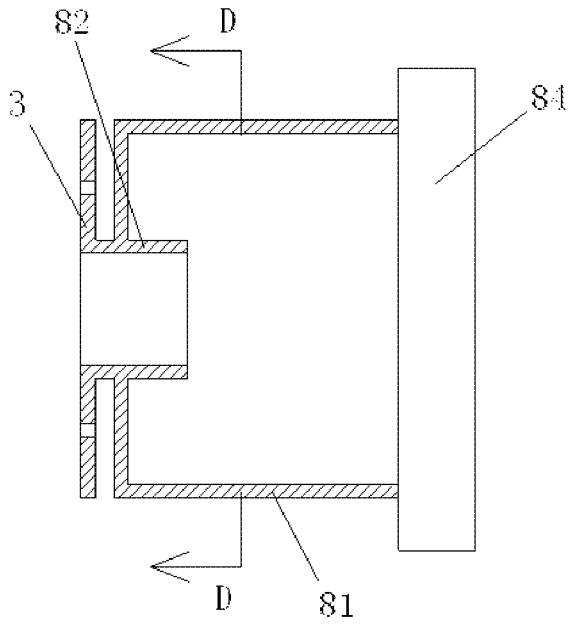
FIG. 3 is a sectional view of the filter in the invention.
Figure 4:
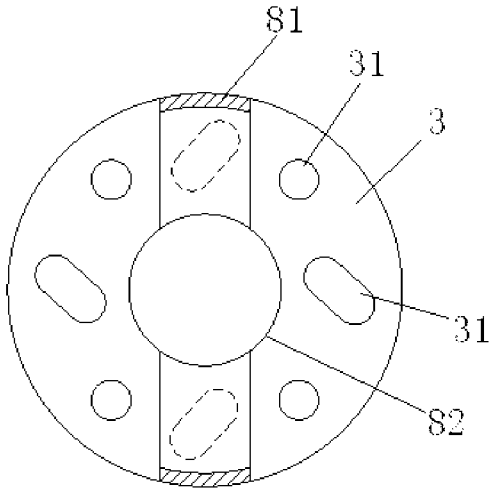
FIG. 4 is a D-D auxiliary view of FIG. 3.
Figure 5:
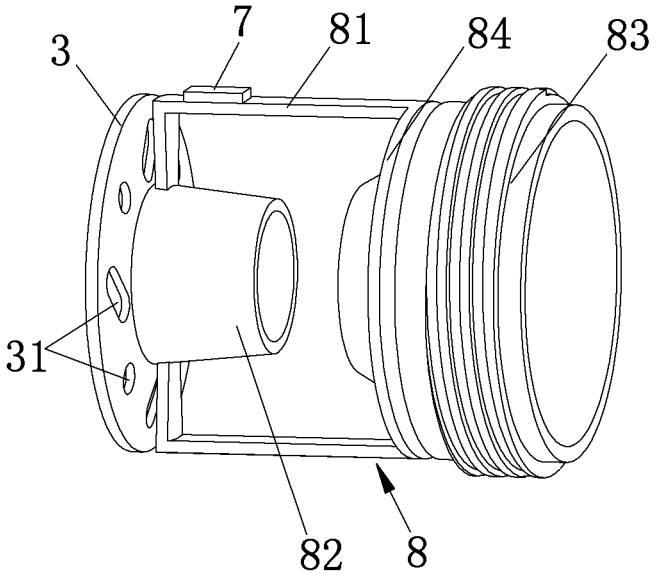
FIG. 5 is a structure schematic drawing of the filter in the invention.

In the most preferred embodiment of the invention, the pressure relief holes 31 are arranged on the pressure parts of the rear pump chamber, as shown in FIG. 2. Thus, it can ensure that there is not too high pressure when the water refluxes from the outlet nozzle to the rear pump chamber, and the pressure may be released to the front pump chamber 92 and the communicated tub.

To make the filter 8 block one side of the rear pump chamber 91 to form a relatively airtight space, the outer diameter C of the spinning blade matches the inner diameter B of the circular rib 93, i.e. the outer diameter of the spinning blade is equal to the inner diameter of the circular rib, or slightly greater or less than the one of the circular rib. The inner diameter of the filter outlet 82 of the filter 8 is less than the outer diameter C of the spinning blade. If the inner diameter of the filter outlet 82 is too large, the pressure space can not be formed in the rear pump chamber 91. Thereby, it is adverse to the draining of the draining pump. The outer diameter of the pressure relief plate 3 is greater than the inner diameter B of the circular rib 93, which avoids the filter channeling via the obstruction of the circular rib 93.

In conclusion, in the draining pump for washing machine of the above technical scheme, the closed pump chamber consists of the pump shell and the right end cover of the filter, and the pressure relief holes for releasing air are arranged on the left end face of the filter. Without additional parts, characterized by simple and reliable structure as well as low failure rate and no additional cost, the draining pump ensures that air-water mixture in the pump shell flows between the pump chamber and the filter chamber during draining. Thus the noise pollution is effectively reduced during the spin drying of washing machine.

Certainly, the invention is not limited to the aforesaid embodiments. Various modifications and alterations of the present invention within the scope of the invention claims and equivalent replacement are apparent to those skilled in the art without departing from the scope and spirit of the invention. The technical scheme is not only applicable to roller washing machine, but also applicable to impeller type washing machine with draining pump and agitator washing machine. The invention contains such modifications and alterations.

The invention claimed is:

1. A draining pump device for washing machine, comprising a draining motor, a pump shell, a spinning blade, and a filter, wherein:

an inlet nozzle and an outlet nozzle are arranged on the pump shell, a front pump chamber and a rear pump chamber are arranged in the pump shell in sequence according to water flow and communicate with each other, the spinning blade is arranged in the rear pump chamber and is coaxial with a revolving shaft of the draining motor, the filter is arranged in the front pump chamber, a pressure relief plate with pressure relief holes is integrally arranged at one side of a filter outlet of the filter next to the spinning blade, a circular rib for supporting the pressure relief plate is arranged between the front and rear pump chambers, the maximum diameter of the pressure relief plate is more than the inner diameter of the circular rib, the outer diameter of the spinning blade is matched with the inner diameter of the circular rib, the filter is a cylindrical frame structure having first and second ends, the first end of the filter being a supporting plate, and the second end of the filter being the filter outlet, and a positioning bump is arranged on one side of the supporting plate facing an inner wall of the front pump chamber.

2. The draining pump device for washing machine according to claim 1, wherein:

the outlet nozzle is radially arranged on the pump shell of the rear pump chamber along the spinning blade, and the inlet nozzle is arranged on the pump shell of the front pump chamber perpendicular to an axial direction of the front pump chamber.

3. The draining pump device for washing machine according to claim 2, wherein:

the supporting plate is connected with the filter outlet via supporting sheets, the filter outlet is of a hollow cylindrical structure, and a pressure relief plate is coaxially arranged on one end of the hollow cylindrical structure near the spinning blade.

4. The draining pump device for washing machine according to claim 1, wherein:

the front pump chamber has first and second ends, the first end of the front pump chamber is communicated with the rear pump chamber, the second end of the front pump chamber is an opening which is closed through a mounting end cover, and the filter is arranged in the front pump chamber through the opening.

5. The draining pump device for washing machine according to claim 4, wherein:

the mounting end cover and the filter are connected with each other, and are relatively rotatable, and the mounting end cover is connected with the front pump chamber through threads in a sealing way.

6. The draining pump device for washing machine according to claim 5, wherein:

the supporting plate is connected with the filter outlet via supporting sheets, the filter outlet is of a hollow cylindrical structure, and a pressure relief plate is coaxially arranged on one end of the hollow cylindrical structure near the spinning blade.

7. The draining pump device for washing machine according to claim 4, wherein:

the supporting plate is connected with the filter outlet via supporting sheets, the filter outlet is of a hollow cylindrical structure, and a pressure relief plate is coaxially arranged on one end of the hollow cylindrical structure near the spinning blade.

8. The draining pump device for washing machine according to claim 1, wherein:

the supporting plate is connected with the filter outlet via supporting sheets, the filter outlet is of a hollow cylindrical structure, and the pressure relief plate is coaxially arranged on one end of the hollow cylindrical structure near the spinning blade.

9. The draining pump device for washing machine according to claim 8, wherein:

the pressure relief plate is of a circular ring structure, the inner diameter of the circular ring is identical with that of the filter outlet and less than the outer diameter of the spinning blade, and the circular ring is evenly provided with pressure relief holes.

10. The draining pump device for washing machine according to claim 9, wherein:

the pressure relief holes are one or more shapes selected from round, oval, square or strip through-holes, and the total area of the pressure relief holes is 0.2-1 times of the section area of the outlet nozzle.

11. The draining pump device for washing machine according to claim 8, wherein:

the outer diameter of the filter outlet is less than the diameter of the supporting plate, the supporting sheet is of an L-shaped structure, and the length of the hollow cylindrical structure is less than the distance between the supporting plate and the pressure relief plate.

12. The draining pump device for washing machine according to claim 11, wherein:

the inner wall of the front pump chamber is axially provided with a positioning slot matched with the positioning bump along the front pump chamber from the opening, and the positioning slot is not on the same axial line as the inlet nozzle.

13. The draining pump device for washing machine according to claim 11, wherein 2-4 sets of the supporting sheets are provided.

14. The draining pump device for washing machine according to claim 1, wherein:

the pressure relief holes are one or more shapes selected from round, oval, square or strip through-holes, and the total area of the pressure relief holes is 0.2-1 times of the section area of the outlet nozzle.

15. A washing machine, comprising an inlet system and a draining system containing the draining pump device according to claim 1.

* * * * *